United States Patent [19]

Martin

[11] 4,307,535

[45] Dec. 29, 1981

[54] AERODYNAMIC DEVICE

[75] Inventor: Lucian D. Martin, Kenwood, Okla.

[73] Assignee: Stanley W. Wilcox, Tulsa, Okla. ; a part interest

[21] Appl. No.: 133,016

[22] Filed: Mar. 24, 1980

[51] Int. Cl.[3] ..... A63H 27/00

[52] U.S. Cl. ..... 46/74 D; 273/426; 273/424

[58] Field of Search ..... 46/74 D, 82; 273/336, 273/425, 424, 426, 428; D21/85, 86

[56] References Cited

U.S. PATENT DOCUMENTS

| | | | |
|---|---|---|---|
| 1,368,176 | 2/1921 | McMillan | 273/426 |
| 1,488,687 | 4/1924 | Kira | 46/82 |
| 3,565,434 | 2/1971 | Liston | 273/426 |
| 3,860,203 | 1/1975 | Hyde | 46/82 |
| 4,063,382 | 12/1977 | McCallum | 273/336 |
| 4,157,632 | 6/1979 | Everett | 46/74 D |
| 4,203,249 | 5/1980 | Böhm | 46/74 D |

*Primary Examiner*—Gene Mancene
*Assistant Examiner*—Michael J. Foycik
*Attorney, Agent, or Firm*—Head and Johnson

[57] ABSTRACT

An aerodynamic device for being launched for flight through the air and having three inherent parameters of rotation while moving through the air, the first being a yawing vector imparted by the launcher as the device rotates about its own center of symmetry, the second being a roll vector as it rotates about an axis parallel to its direction of flight, and the third being rotation of the device very slowly about a center which is determined by the launching point whereby a boomerang action is provided. The device comprises a substantially annular body having three symmetrically disposed lobes extending radially outwardly therefrom, with each lobe being of a substantially undulated cross-sectional configuration to provide a subtle lateral curvature for the device which is critical to the flight behavior thereof, the lateral curvature of the lobes providing a lifting surface for sustaining the device in a state of levitation during movement through the air, and a reverse curvature at the tips of the lobes providing stabilization and control of the roll flight axis of the device.

2 Claims, 4 Drawing Figures

AERODYNAMIC DEVICE

BACKGROUND OF THE INVENTION

1. Field of the Invention

This invention relates to improvements in aerodynamic devices, and more particularly, but not by way of limitation, to a boomerang type aerodynamic device.

2. Description of the Prior Art

There are many aerodynamic devices of the type adapted to be thrown or launched through the air from one player to another or in such a manner as to achieve unexpected movement of the device due to the contour thereof and the air currents through which the device moves. One example is the device known as a Frisbee, a trademark of Wham-O Mfg. Co., which is a flying disc adapted to be thrown by one player or person in a wrist twisting action in a direction away from the person, and usually in the direction of another player. Other such devices are known which have a boomerang action when thrown into the air with a proper twisting motion. These devices have achieved a substantially great degree of popularity and there is a demand for new challenges in the action and performance of these devices as persons become more skilled in the operation thereof.

SUMMARY OF THE INVENTION

The present invention contemplates a novel aerodynamic device of the boomerang type which is of a subtle nature in its design to produce an intriquing path of travel when launched into the air. The novel device comprises a substantially annular body portion having a central bore and three radially outwardly extending symmetrically arranged lobes, each lobe having a substantially undulating cross-sectional configuration with a first arcuate portion having one edge terminating at the central bore and the apex thereof cooperating with the apex of each of the other lobes to define a main plane for the device. A second arcuate section of a reverse curvature with respect to the first arcuate section is blended subtly into the outer edge of the first arcuate portion and terminates at the tip of the lobe to provide a stabilizer for control of the roll flight of the device. The laterial curves or the undulating curves of the lobes provide flotational or lifting surfaces for the device which sustain the device in a state of levitation upon being launched into the air. The overall weight of the body is preferably quite light, as for example approximately one ounce, and the combination of curves or arcuate portions of the body generally resembles a helicopter in one dimension, but in action more closely resembles a three bladed boomerang. Upon launching into the air, the device has three inherent parameters of rotation. The first action is a yawing vector as the device rotates about its own center of symmetry, the second action is a planar spinning of the device imparted by the launcher of the device whereby the body rotates about an axis parallel to its direction of flight, and the third action is a slow rotation of the entire body about a central point near or at the point of the launching thereof or determined by the point of launching. The novel device is simple and efficient in operation and economical and durable in construction.

DESCRIPTION OF THE PREFERRED EMBODIMENT

Figure 1:
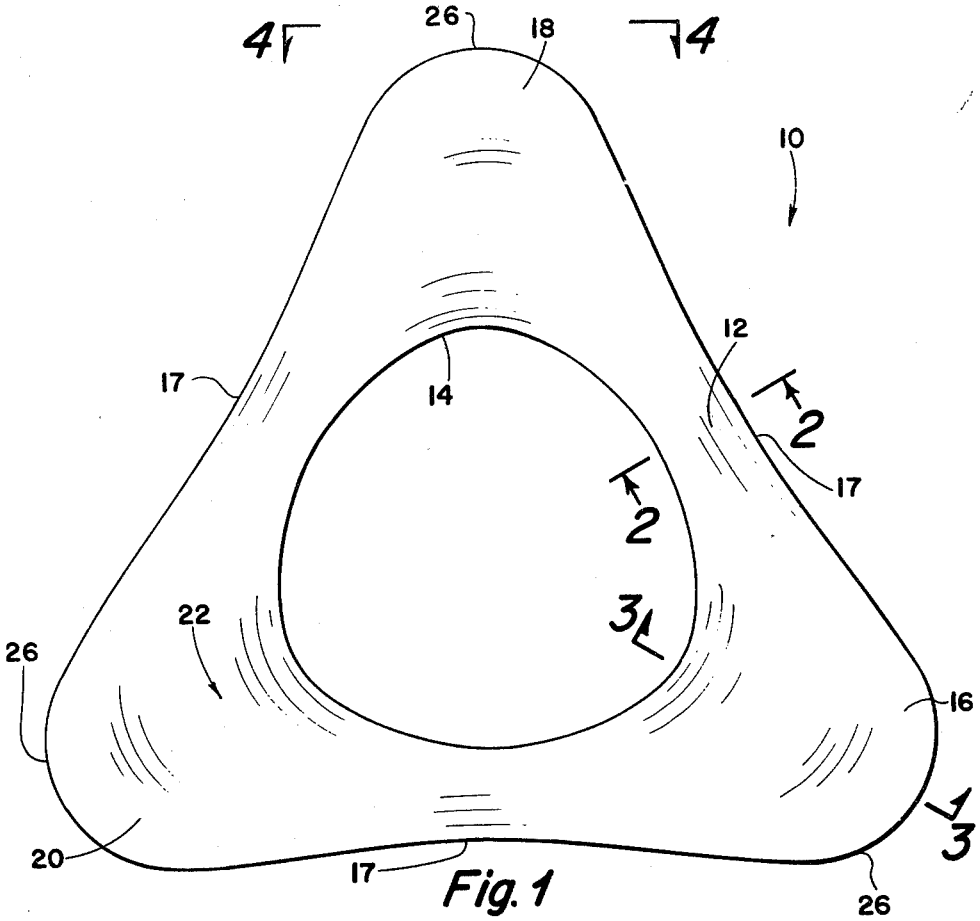
FIG. 1 is a plan view of an aerodynamic device embodying the invention.
Figure 2:
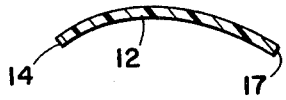
FIG. 2 is a sectional view taken on line 2—2 of FIG. 1.
Figure 3:
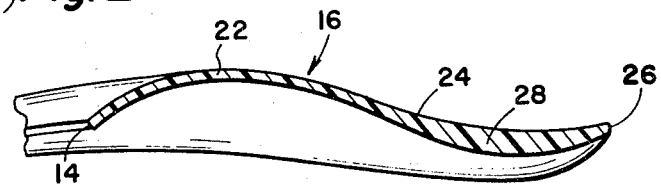
FIG. 3 is a sectional view taken on line 3—3 of FIG. 1.
Figure 4:
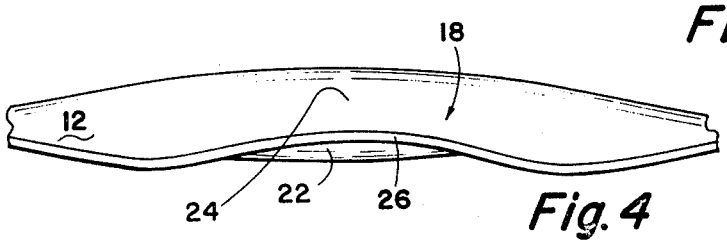
FIG. 4 is a broken side elevational view taken on line 4—4 of FIG. 1.

Referring to the drawings in detail, reference character 10 generally indicates an aerodynamic device comprising a substantially annular body portion 12 having a centrally disposed bore 14 and three substantially identical, radially outwardly extending lobes 16, 18 and 20 symmetrically spaced therearound. The cross-sectional configuration of the annular body 12 is arcuate, as particularly shown in FIG. 2, with the inner edge thereof terminating at the bore 14 and the outer edge 17 thereof terminating at the outer periphery of the body 12. The cross-sectional configuration of each lobe 16, 18 and 20 is substantially identical and is of an undulating appearance comprising a first arcuate section 22 of a configuration generally similar to the arcuate configuration of the body 12, but preferably slightly greater in magnification, and subtly blended into the arc of the body 12 to provide a continuity and smoothness for the opposed surfaces of the device 10. The inner edge of the arcuate section 22 terminates at the bore 16 and the outer edge thereof blends into a second arcuate section 24 which curves in a reverse direction with respect to the curvature of the section 22, as particularly shown in FIG. 3. As a result, the outer periphery of the tip 26 of each lobe is of a reverse curved configuration with respect to the curvature of the inner edge of the lobe, thus providing stabilization of the flight of the device 10, as will be hereinafter set forth.

In addition, the thickness of each lobe is increased in a direction toward the outward flaring of the arcuate section 24 as shown at 28 in order to provide a selected mass distribution of the material from which the device 10 is constructed. In other words, the material of the lobes is thickened toward the outer edges thereof while the inner arcuate section 22 of each lobe is preferably a relatively thin web section. The importance of the mass distribution of the material of construction has been found to be an important factor, if not the most important key, to the behavior of the device 10 in the air. The mass distribution provided by the thickened portions 28 of the arcuate sections 24 causes a shift of the weight of the device 10 to the outer periphery thereof, and thus provides the inertia for energy storage to produce long sustained flights therefor.

The device 10 is preferably constructed from a suitable lightweight plastic material whereby the overall weight of the device is maintained at a minimum. For example, a device 10 having an overall or maximum dimension of approximately eight inches should preferably weigh about one ounce, although it is possible that other weight-size ratios may function equally well in the operation of the device. As hereinbefore set forth, the curved sections 22 and 24 are subtle in nature and are critical to the flight behavior of the device 10. These arcuate sections are the flotational or lifting surfaces which sustain the device 10 in a state of levitation. The reversed curvature at the outer periphery of the tips 26 of the lobes functions as a stabilizer for each lobe and controls the roll flight axis of the device.

In use, the device may be launched into the air by hand or in any other suitable manner with a slight spinning motion in a forward direction by the hand of the user of the device. This imparts an initial rotation of the device which is a yawing vector expressed as rotation about the center of symmetry of the device. A second inherent movement for the device during its flight is a rolling vector expressed as rotation about an axis substantially parallel to the direction of flight thereof. In other words, the device tends to spin in the plane determined by the "high points" or apexes of the curved section 22 during the yawing action. The third inherent movement of the device is a slow rotation of the entire body about a center point near or at the point of launching or about a central point determined by the launch site. This last vector causes the device to have a boomerang action.

When the device is launched for return to the launcher in a boomerang style, the device is preferably hand launched in a fashion similar to the aforementioned Frisbee, although it is readily apparent that practice with throwing of the device will result in the discovery of many other launching methods which will achieve a variety of desirable or satisfactory results. Of course, the wind or ambient atmospheric conditions may be used as an aid for complimenting the overall action of the device.

One particularly enticing action for the device is provided by launching thereof in a manner wherein the lifting surfaces are disposed upwardly, or in an upside down position with respect to the usual launching of the Frisbee. In this attitude, the device appears to store energy of rotation as it reaches the high point in its flight trajectory, at which point, it flips over as it rotates in the second or roll axis vector. It then presents itself for sustained flight when the lifting surfaces come into action and take command of the flight of the device.

Under experimental flight conditions of the device 10, it has been found that vigorous launching thereof may cause the device to roll 360°, while upon improper launching the body may roll approximately 90° and dive or drop into the ground for aborting the flight. Under cooperative wind conditions, it has been found that the usual flight path of the device is a widening circle of the third vector, and with skill in launching the device will return to the hand of the launcher, or may sweep around in front, or behind the launcher. It has also been found that one interesting characteristic of the flight path of the device is that the body may dip or fly in a direction toward the ground, but recover from the diving attitude and resume its flight in much the same manner as the flight of a helicopter. Vigorous launching of the device in a substantially vertically upward direction will normally result in a very high flight orbit therefor. Launching of the device in the attitude which would normally be considered "right side up" as compared to the normal launching of the Frisbee will normally result in a return movement of the device through the same path as the outgoing movement, a characteristic which is usually found in a three bladed boomerang. Of course, the device 10 may be sailed or flung through the air directly from one player to another, as in the case of the Frisbee, and in this instance the path of the device 10 is usually a substantially straight line, with the device deviating to the right or left before reaching the intended receiver.

The possible uses of the device 10 are numerous. For example, the body 12 and lobes 16, 18 and 20 or any portions thereof, may be coated with a suitable reflective paint, or the like, and launched either singly or in multiples in a lighted area at night to produce a substantially spectacular visual apparition. Another possible use for the device 10 is as a target for skeet shooters, or the like. In this instance, the device is preferably constructed from a suitable friable target material and may be launched, either singly or in multiples, to provide a bevy of "birds" in the air at one time, thus providing targets for the gunman or skeet shooter, with the entire operation being accomplished by the shooter himself.

The launcher imparts a forward spinning motion to cause the device to yaw about its center of gravity. The increased lift from the lobe progression in the direction of flight and the decreased lift from the one receding from the direction of flight causes the device to slowly rotate about an axis drawn through the plane of the device in the direction of flight. The device is primarily a solo user vehicle; however, with skill, the device can be flown between two users with the launcher in control of the flight trajectory and can cause the device to veer to the right or left at the end of its flight path.

From the foregoing it will be apparent that the present invention provides a novel aerodynamic device comprising a substantially annular body having three symmetrically arranged lobes extending radially therefrom, with the lobes being constructed of a subtle lateral cross-sectional configuration which produces a flight path for the device which has three inherent vectors, thus producing a great many variations of flight behavior. The novel device may be utilized for entertainment and exercise purposes, or may be utilized in actions of a more scientific nature.

Whereas the present invention has been described in particular relation to the drawings attached hereto, it should be understood that other and further modifications, apart from those shown or suggested herein may be made within the spirit and scope of this invention.

What is claimed is:

1. An aerodynamic device for launching by hand in which a spinning motion is imparted to the device as it is launched, comprising:

a unitary annular body of relatively thin and rigid material for rotation about an axis, the body having a large axial opening therein and being defined by at least three integral increased radial length lobe portions, each lobe being defined in cross-section in a plane of the rotational axis by a convex upper surface and concave lower surface adjacent the axial opening, such surfaces gradating towards the outer end portions of the lobe which has a reverse curvature formed by an upper slightly concave surface and a lower slightly convex surface, and wherein the portions of the body intermediate the lobe portions are of shorter radial length and are defined in cross-section in a plane of the rotational axis by a convex upper surface and concave lower surface, the surfaces of the intermediate portions gradating to the lobe portions providing smooth aerodynamic transitions in all portions of the body, the body being symmetrical as to all cross-sections taken in a plane parallel the rotational axis and perpendicular a radius extending through each lobe portion or a radius extending through each portion intermediate adjacent lobes.

2. An aerodynamic device according to claim 1 wherein the thickness of the material of which the device is formed is increased at the outer end portions of each lobe portion.

* * * * *